United States Patent [19]

Scapardine

[11] 3,983,342

[45] Sept. 28, 1976

[54] MULTIPLE CONTACT PERIODIC SWITCH HAVING FLEXIBLE RADIALLY EXTENDING CONTACTS CONNECTED TO IGNITION COIL WINDINGS

[75] Inventor: James D. Scapardine, Chicago, Ill.

[73] Assignee: Lawrence Peska Associates, Inc., New York, N.Y. ; a part interest

[22] Filed: Jan. 30, 1975

[21] Appl. No.: 545,577

[52] U.S. Cl. ..... 200/26; 200/24; 123/148 R; 315/226

[51] Int. Cl.[2] ..... H01H 19/00; F02P 7/00

[58] Field of Search ..... 200/8 R, 8 A, 19 R, 200/19 A, 19 DR, 19 DC, 24, 26, 27 R, 29, 30 R, 30 A, 31 R, 31 A, 243; 123/148 R; 315/209 R, 226

[56] References Cited

UNITED STATES PATENTS

| | | | |
|---|---|---|---|
| 1,372,065 | 3/1921 | Conklin | 200/19 DR UX |
| 2,399,022 | 4/1946 | Harkness | 200/26 |
| 2,716,164 | 8/1955 | Anderson | 200/27 R |
| 2,852,636 | 9/1958 | Block et al. | 200/19 R X |
| 2,990,459 | 6/1961 | Stanbro et al. | 200/30 A X |
| 3,261,928 | 7/1966 | Schlesinger, Jr. | 200/8 A |
| 3,506,796 | 4/1970 | Roschilla | 200/8 R X |

*Primary Examiner*—James R. Scott
*Attorney, Agent, or Firm*—Jack D. Slobod

[57] ABSTRACT

An ignition system for an internal combustion engine which includes a distributor having an elongated rotor which is carried for rotation about a generally perpendicular axis in phased relationship to the input shaft of the engine. A plurality of contacts are disposed about the rotor in a circle. Each contact is movable radially between first and second positions responsive to contact by the rotor.

1 Claim, 2 Drawing Figures

MULTIPLE CONTACT PERIODIC SWITCH HAVING FLEXIBLE RADIALLY EXTENDING CONTACTS CONNECTED TO IGNITION COIL WINDINGS

BACKGROUND OF THE INVENTION

The invention relates to internal combustion engines and particularly to distributors and ignition systems therefor. The prior art includes a number of ignition systems and distributors for automobile engines. The most common arrangement is a single set of breaker contacts or points which are used to sequentially make and break a circuit from the coil. When the contacts are closed current flows from the ignition switch through the coil and then thence through the breaker contacts to ground which causes a magnetic field to build in the primary windings of the coil. As a cam on the distributor shaft turns one of its eccentric lobes moves the contacts to the open position thus breaking the complete circuit. This in turn collapses the magnetic field of the primary windings of the coil. Various structures have been provided to build and collapse the magnetic field in the coil. A disadvantage of existing mechanical systems is that the contacts or points deteriorate in time resulting in maintenance and in some cases automobile breakdowns.

Apparatus having a general similarity to the apparatus of the present invention is shown in the following U.S. Pat. Nos.: Vogel, 2,587,013; Thomas, 2,820,857; Stanbro, et al, 2,990,459; Felson, 3,249,730; and Penrose, 3,347,999.

It is a primary object of the invention to produce apparatus which will require less maintenance in mechanical systems heretofore used.

It is still another object of the invention to provide apparatus which will facilitate easy maintenance when maintenance is required.

Still another object of the invention is to provide apparatus which is simple and inexpensive to manufacture.

SUMMARY OF THE INVENTION

It has now been found that these and other objects of the invention may be attained by a distributor for internal combustion engines which includes a rotor having an elongated member carried for rotation about an axis generally perpendicular to the direction of elongation. A plurality of contacts are disposed in a circle about the axis. Each contact is carried for radial movement away from the axis and each is movable between a first position a first distance from the axis and a second position which is at a greater distance from said axis than said first distance.

The rotor is rotated in phased relation to the output shaft of the engine and has one end touching each of the contacts sequentially when rotated through a 360° arc. Each of the contacts is displaced to the second position when touched by the rotor.

Normally the contacts are biased to the first position and electrical conductors are provided for coupling all of the contacts electrically in series when the contacts are in the first position. The series connection is interrupted if any of the contacts is disposed in the second position. The rotor may be adjustable in length to vary the amount of touching with each contact as it is urged through its circular path. The contacts are ordinarily electrically coupled to a plurality of spark plugs in the second position and normally the contact will comprise a ball which cooperates with a pair of arcuate members disposed about the axis in the first position.

BRIEF DESCRIPTION OF THE DRAWING

The invention will be better understood by reference to the accompanying drawing in which.

DESCRIPTION OF THE PREFERRED EMBODIMENT

Figure 1:
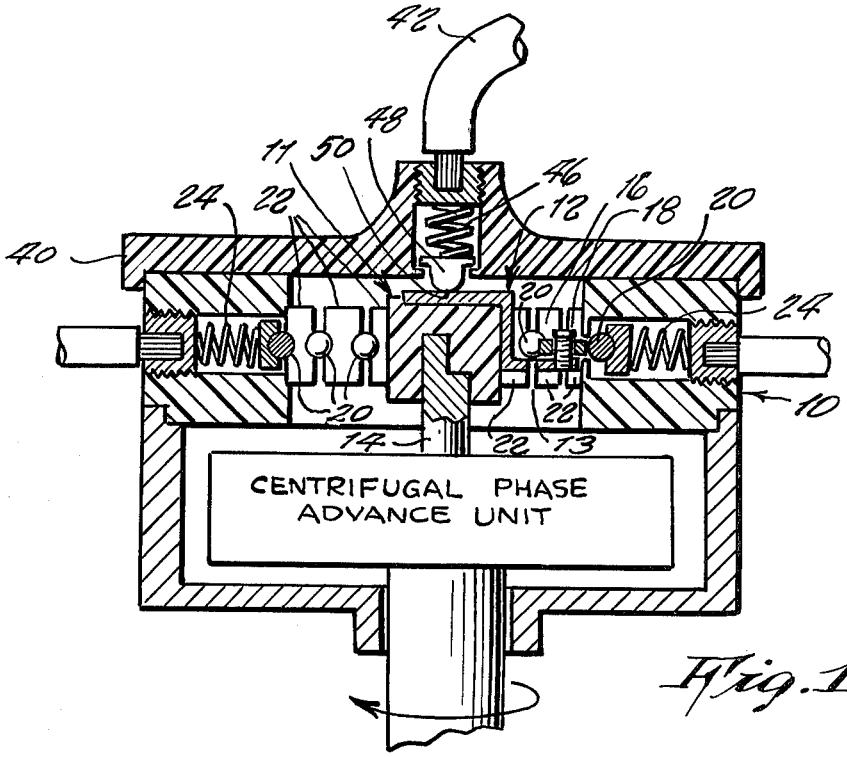
FIG. 1 is an elevational cross-sectional view of an ignition and distributor device in accordance with the present invention.
Figure 2:
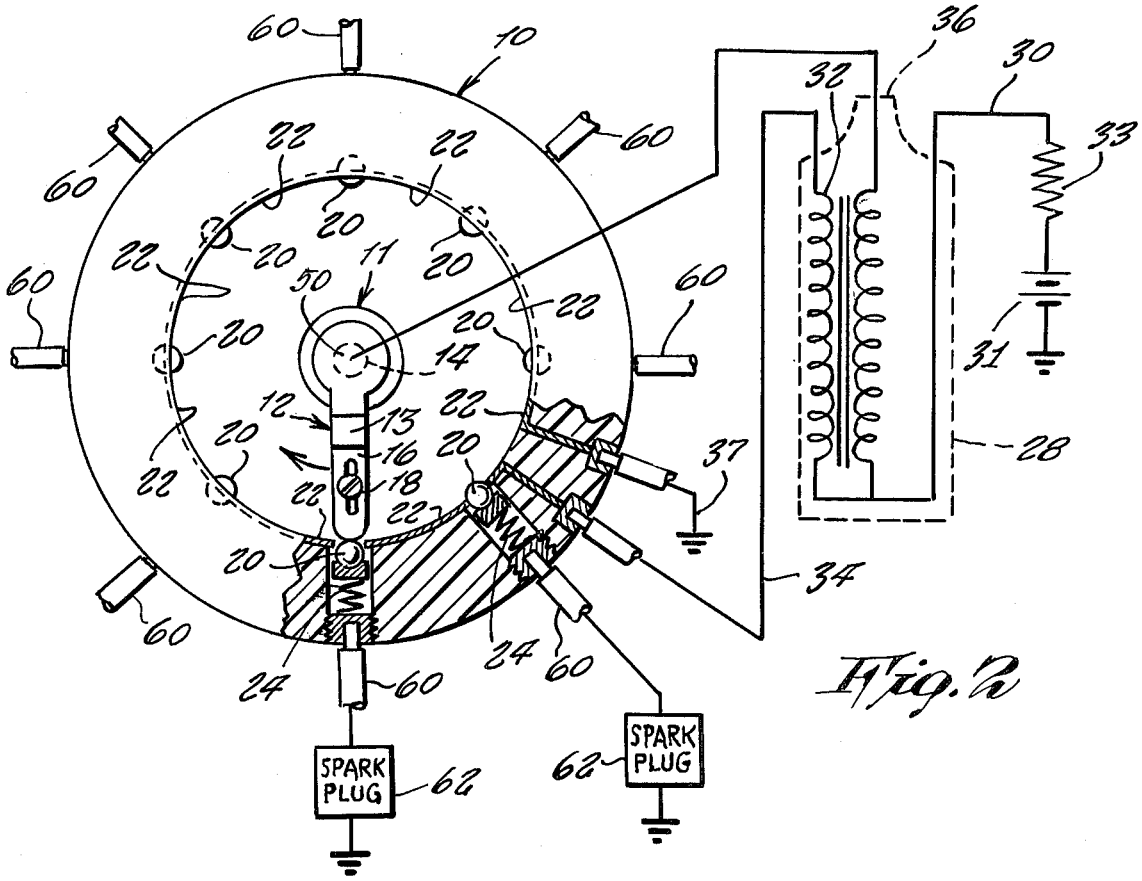
FIG. 2 is a partially broken away plan view of the device in FIG. 1 with a distributor cap removed, in conjunction with schematically illustrated associated parts of an ignition system.

Referring now to FIGS. 1 and 2 there is shown an annular housing 10 within which is coaxially disposed a rotor assembly 11 carrying a radially elongated electrically conductive arm 12; which includes a center section 13 for rotation with a generally vertical central drive shaft carrying assembly 11. It will be understood that although the terminology vertical and horizontal may be used herein that this merely refers to an illustrative form of the invention. The arm 12 is provided with an elongated section 16 which is secured by means of a screw 18 to the center section 13 thereof. By means of the screw 18 the effective radial length of the arm 12 may be varied. Disposed in a circle about the axis 14 are a plurality of contacts 20 mounted for radical movement and which are biased in a horizontal plane toward the axis 14 by springs 24 (one shown). Disposed intermediate the contacts 20 are split ring sections or arcuate members 22 which cooperate with the contacts in one position thereof. More particularly the spring 24 urges each contact to a first position where it bears against two separate ring sections 22, 22.

Normally each contact 20 is disposed in a first position where it protrudes radially inward from housing 10 and abuts or bridges two adjacent arcuate members 22. Rotation of the rotor 12 about the axis 14 will sequentially cause the member 16 to contact or touch the contacts 20 and push the touched contact radially outward from abutting relationship to members 22. Referring particularly now to FIG. 2 it is apparent that the coil 28 receives power on conductor 30 from the usual series combination of an auto battery 31 and ballast resistor 33. This current flows through winding 32 and thence by means of conductor 34, which passes through opening 36 in the housing 10, to one of the arcuate members 22. It will be seen when arm 12 does not engage any of the contacts 20, a series circuit is made of the plurality of contacts 20 and arcuate members 22 which are connected to provide a ground 37 for the winding 32 for enabling current flow therebetween. Upon arm 12 engaging a contact 20, this flow of current is suddenly interrupted, because of breaking this series circuit, causing the collapse of magnetic field about winding 32 and an induction of high voltage in the winding 40. Conductor 42 is connected thereto which extends to the distributor cap 44 which has a spring 46 for urging a ball shaped contact 48 against a contact surface 50 of the arm 12. Thus, high voltage is delivered sequentially to the sparkplugs 62 via the contact 20 engaged by arm 12, spring 24 and a spark-plug wire 60 coupled between the spring and spark-plug.

Having thus described my invention, I claim:

1. A distributor device for an internal combustion engine which comprises: an electrically conductive split ring member having a first non-conductive gap separating angularly spaced apart opposite ends of said member; a pair of first terminals coupled respectively to said opposite ends for connecting said split ring member in a first circuit in series with the primary winding of an ignition coil; said split ring member being formed by plural angularly spaced apart electrically conductive arcuate sections separated by second non-conductive gaps, plural radially moveable contacts respectively disposed in said second gaps, electrically conductive spring means extending radially outward from said contacts for biasing said contacts to a first position characterized by said contacts protruding radially inward from the inside diameter of said split ring member with said contacts respectively electrically bridging between adjacent ring sections on opposite sides of each contact for completing said first circuit; plural second terminals respectively electrically coupled to said spring means for feeding a plurality of spark plugs; a rotor carried within said split ring member for rotation about the axis of said member; said rotor including a radially elongated electrically conductive arm of a length for sequentially engaging said contacts in response to rotation of said rotor; said arm being of a length for driving an engaged one of said contacts radially outward and away from said adjacent ring sections on either side of said contact for opening said first circuit; and conductive wiper means for constantly engaging said arm, despite the rotation of said rotor, for enabling said arm to be electrically coupled to the secondary winding of said igniton coil.

* * * * *